US006464075B2

(12) United States Patent
Tan

(10) Patent No.: US 6,464,075 B2
(45) Date of Patent: Oct. 15, 2002

(54) TOP CUFF WITH CLUB SHAFT POSITIONING MEANS FOR GOLF BAG

(76) Inventor: Fu-Hsing Tan, 4th Fl., 101-1, Chi Lin Road, Yang Chou Tsun, Lu Chu, Taoyuan Hsien (TW)

( * ) Notice: Subject to any disclaimer, the term of this patent is extended or adjusted under 35 U.S.C. 154(b) by 0 days.

(21) Appl. No.: 09/788,376

(22) Filed: Feb. 21, 2001

(65) Prior Publication Data

US 2002/0115494 A1 Aug. 22, 2002

(51) Int. Cl.[7] ..... A63B 55/02
(52) U.S. Cl. ..... 206/315.4; 211/70.2
(58) Field of Search ..... 206/315.6, 315.2, 206/315.3, 315.4; 211/70.2, 70.5, 60.1, 69.5; 280/DIG. 5, DIG. 6

(56) References Cited

U.S. PATENT DOCUMENTS 3,139,132 A * 6/1964 Shiller ..... 206/315.6
5,267,660 A * 12/1993 Kwon ..... 206/315.6
5,918,490 A * 7/1999 Lion ..... 206/315.3
D423,221 S * 4/2000 Hong ..... D3/320
6,085,901 A * 7/2000 Lin ..... 206/315.2

* cited by examiner

*Primary Examiner*—Nathan J. Newhouse
*Assistant Examiner*—Lien Ngo
(74) *Attorney, Agent, or Firm*—Troxell Law Office PLLC

(57) ABSTRACT

A top cuff for golf bag having a plurality of golf club insertion compartments and a club shaft positioning device in each golf club insertion compartment, the club shaft positioning device each having at least one hard locating plate and at least one flexible engagement plate alternatively disposed at two sides at different elevations, each hard locating plate having peripheral notches for the positioning of the shaft of each inserted golf club, each flexible engagement plate having a plurality of retaining portions corresponding to the peripheral notches of each hard locating plate for pressing on the shaft of each inserted golf clubs.

6 Claims, 13 Drawing Sheets

TOP CUFF WITH CLUB SHAFT POSITIONING MEANS FOR GOLF BAG

BACKGROUND OF THE INVENTION

The present invention relates to a golf bag and, more specifically, to a top cuff with club shaft positioning means for golf bag, which has means to hold the shaft of each golf club being inserted into the golf bag against vibration without causing a friction damage.

A golf bag is used for carrying golf clubs including putters, iron clubs and wooden clubs. When moving or tilting a golf bag or putting it on the ground, the loaded golf clubs may be forced to hit one against another, causing a damage to the surface of the shaft of each golf club. In order to eliminate this problem, positioning means shall be used to hold golf clubs in the golf bag in good order.

SUMMARY OF THE INVENTION

The invention has been accomplished under the circumstances in view. It is the main object of the present invention to provide a top cuff for golf bag, which club shaft positioning means that holds down the shaft of each inserted golf club in place. It is another object of the present invention to provide a top cuff for golf bag, which keeps inserted golf clubs in place without causing damage to the surface of the shaft of each inserted golf club. According to one aspect of the present invention, the top cuff comprises a plurality of golf club insertion compartments and a club shaft positioning device in each golf club insertion compartment. The club shaft positioning device comprises at least one hard locating plate and at least one flexible engagement plate alternatively disposed at two sides at different elevations. Each hard locating plate comprises a plurality of peripheral notches for the positioning of the shaft of each inserted golf club. Each flexible engagement plate comprises a plurality of retaining portions corresponding to the peripheral notches of each hard locating plate for pressing on the shaft of each inserted golf club. According to another aspect of the present invention, the top cuff and the club shaft positioning device are made of foam material, therefore the club shaft positioning device does not damage the surface of the shaft of each golf club being inserted into the top cuff.

DETAILED DESCRIPTION OF THE PREFERRED EMBODIMENT

Figure 1:
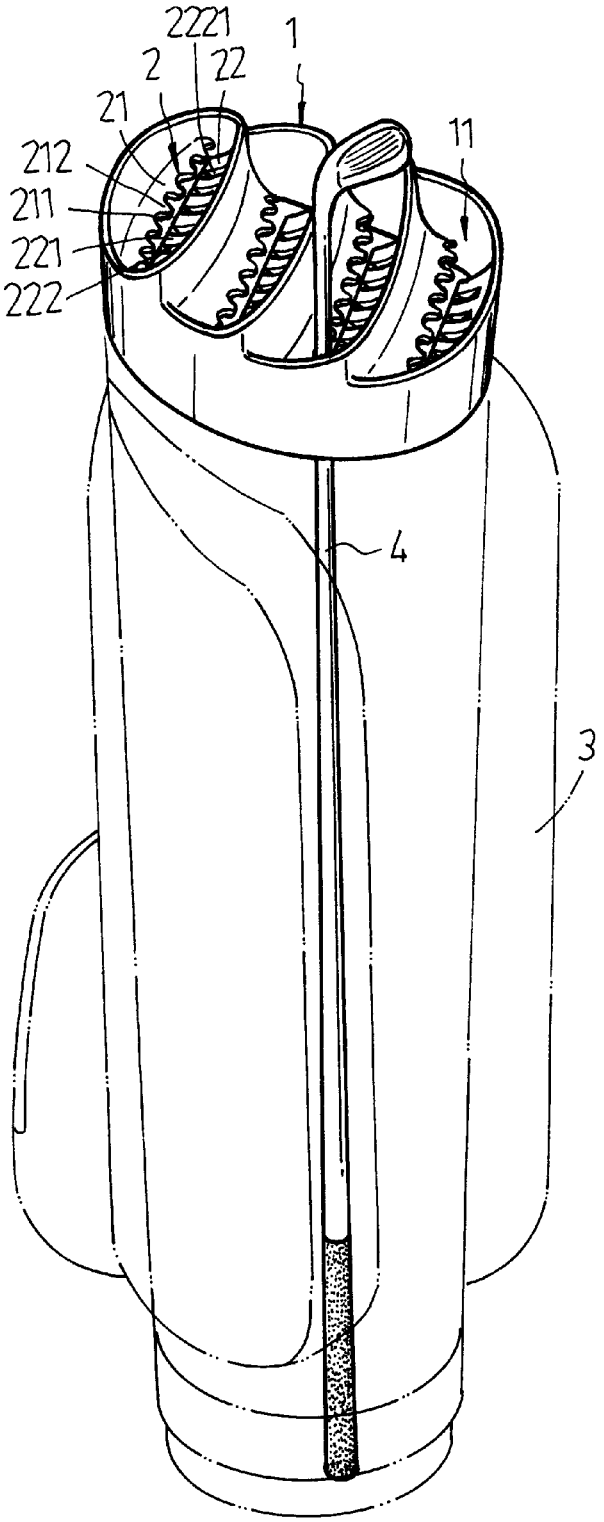
FIG. 1 illustrates a top cuff installed in a golf bag according to the present invention.
Figure 2:
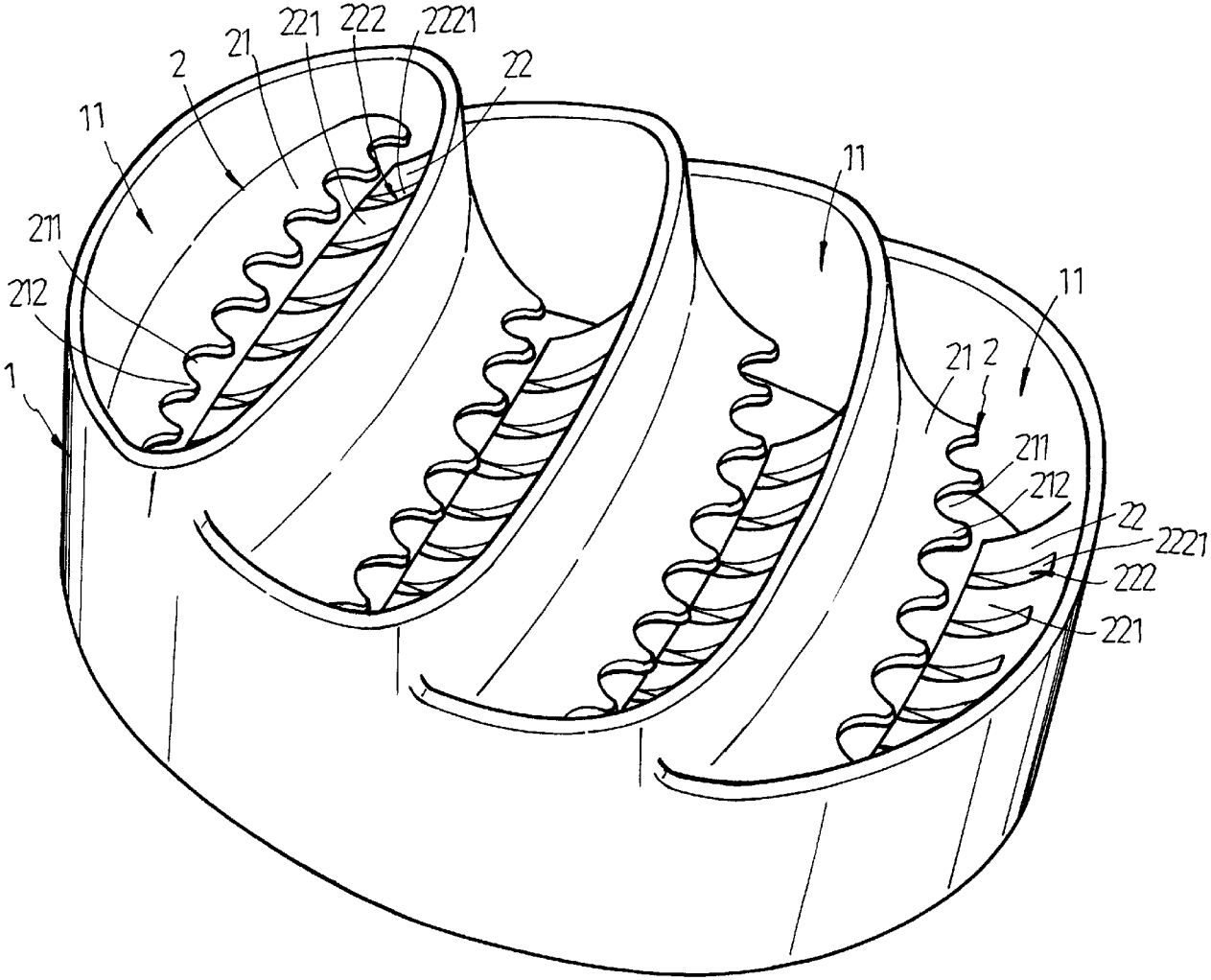
FIG. 2 is an elevational view of a top cuff for golf bag according to the present invention.
Figure 3:
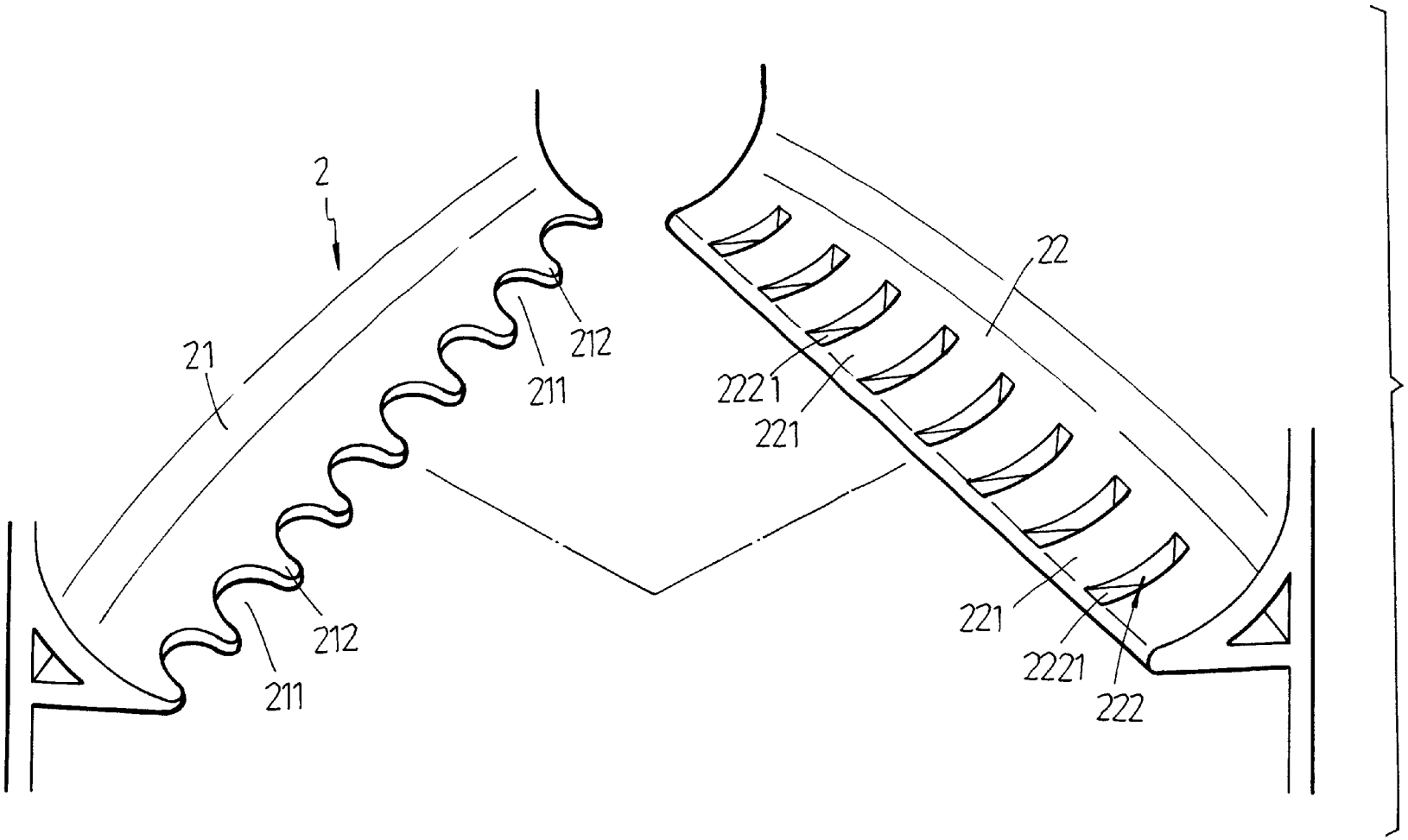
FIG. 3 is an extended out view of a part of the present invention.
Figure 4:
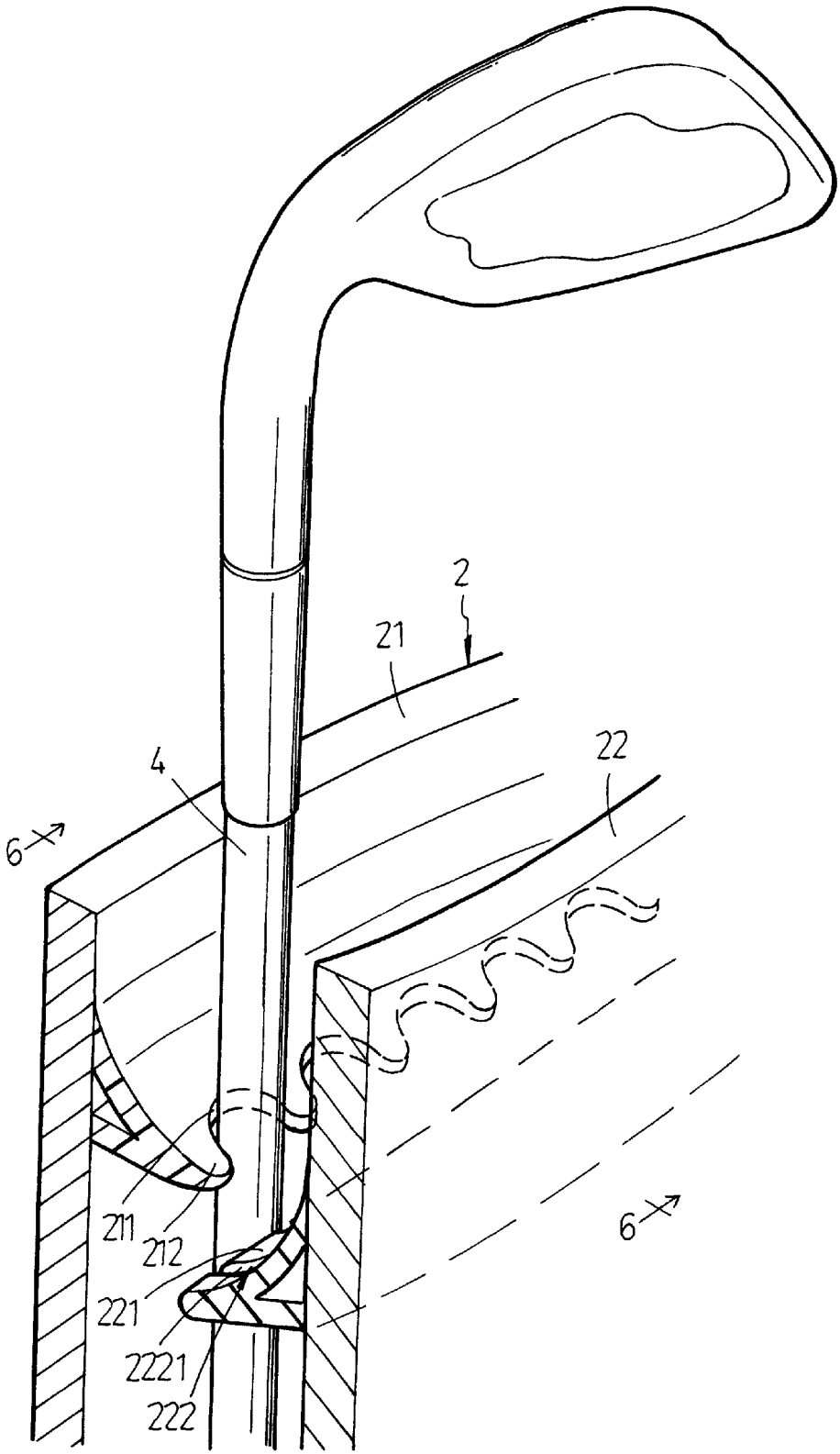
FIG. 4 illustrates the shaft of a golf club positioned in one peripheral notch of the hard locating plate according to the present invention.
Figure 5:
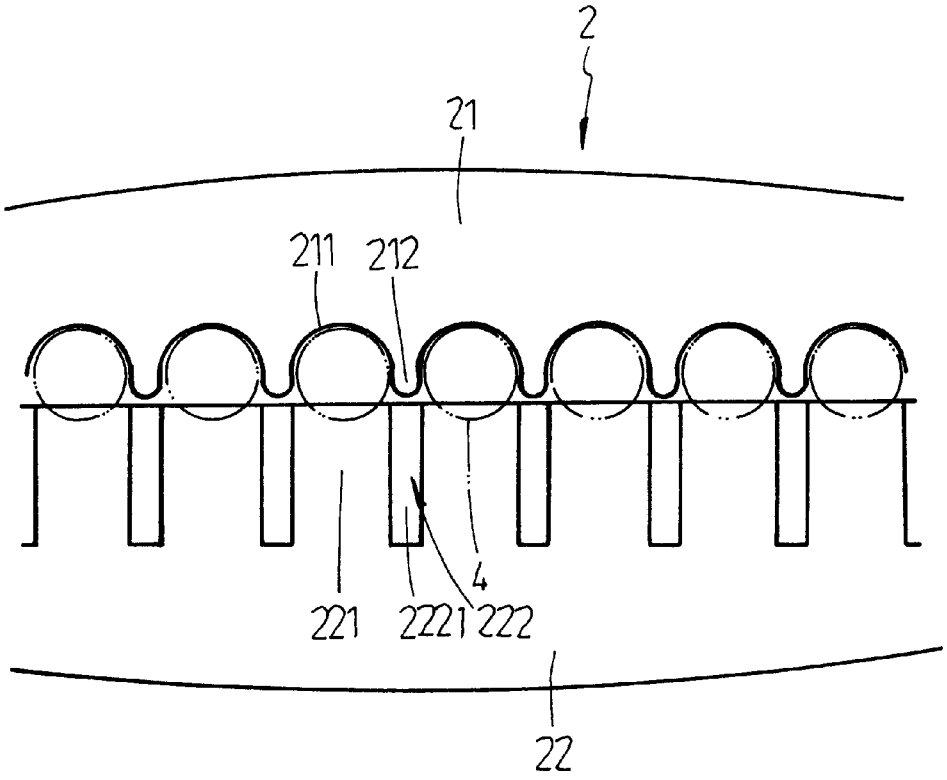
FIG. 5 is a top plain view of the club shaft positioning device in one insertion compartment according to the present invention.
Figure 6:
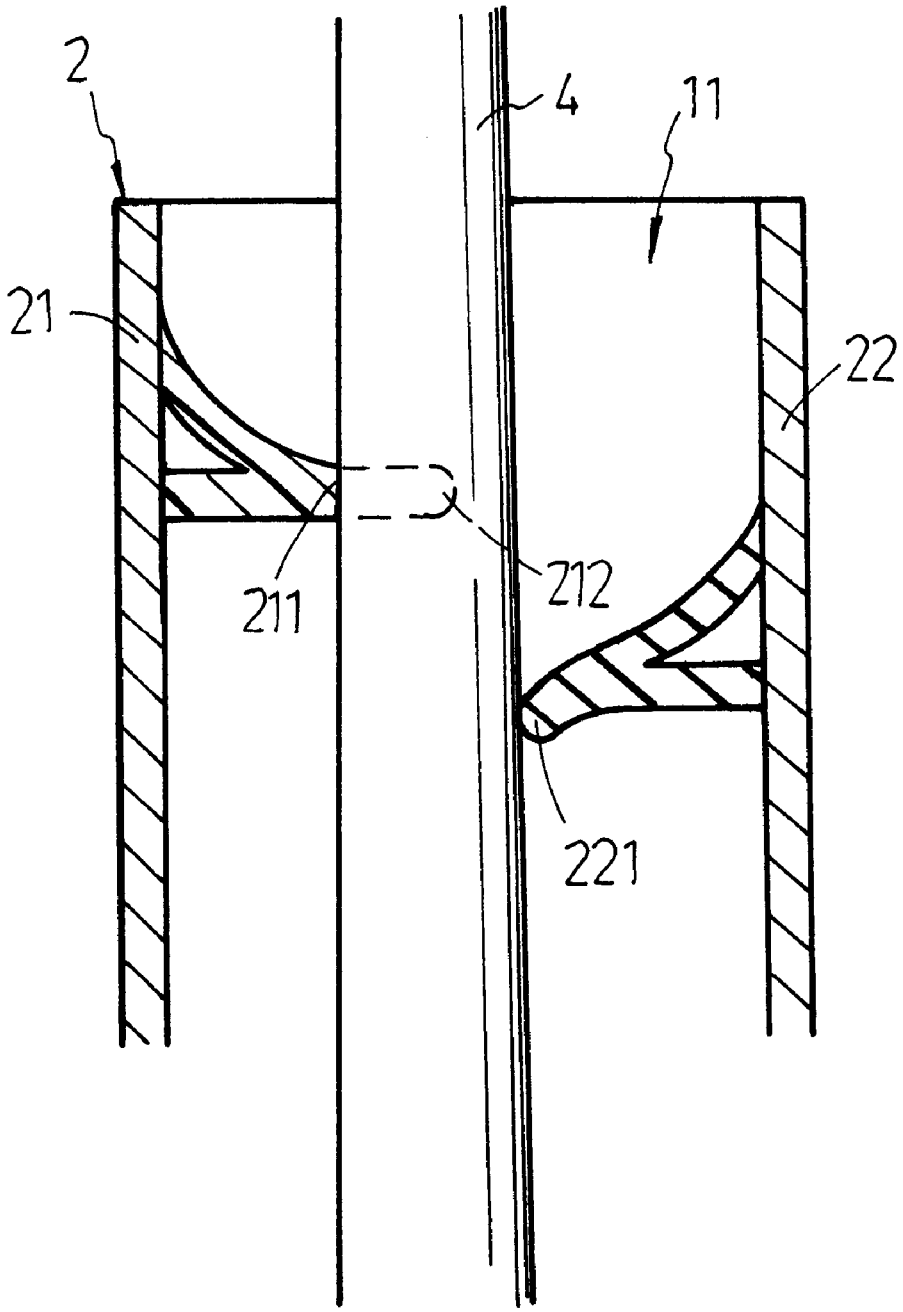
FIG. 6 is a sectional view taken along line 6—6 of FIG. 4.

Referring to FIGS. from 1 through 4, a top cuff 1 is provided at the topside of a golf bag 3. The top cuff 1 defines therein a plurality of insertion compartments 11. Club shaft positioning devices 2 are respectively provided in the insertion compartments 11 for holding down the shaft of each golf club 4 being inserted into the golf bag 3. Each club shaft positioning device 2 comprises at least one hard locating plate 21 and at least one flexible engagement plate 22 alternatively disposed at two sides at different elevations. The hard locating plate 21 is disposed above the elevation of the corresponding flexible engagement plate 22. Each hard locating plate 21 and each flexible engagement plate 22 have a respective inner side and a respective outer side. The outer side of each hard locating plate 21 extends toward the corresponding flexible engagement plate 22. Each hard locating plate 21 has a wall thickness made gradually thinner from the respective inner side toward the respective outer side, a plurality of peripheral notches 211 and chamfered ribs 212 alternatively arranged in a line along the respective outer side. Each flexible engagement plate 22 has a plurality of groove means 222 on the front side thereof corresponding to the chamfered ribs 212 of the adjacent hard locating plate 21. According to the present preferred embodiment, the groove means 222 are shadow grooves arranged in parallel: and respectively extended to the front side of the flexible engagement plate 22, defining a plurality of linked retaining portions 221 corresponding to the peripheral notches 211 of the hard locating plate 21.

Referring to FIGS. from 4 through 6, top cuff 1 and the club shaft positioning devices 2 are made of foam material, therefore when contacting the golf clubs inserted therein, the golf clubs do not displace to hit one against another. Because the locating plate 21 is relatively harder, the shaft of the inserted golf club 4 can be stably positioned in one peripheral notch 211 and retained in place by one retaining portion 221 of the adjacent flexible engagement plate 22. Upon insertion of the golf club 4 in one peripheral notch 211 of the hard locating plate 21, the corresponding retaining portion 221 of the adjacent flexible engagement plate 22 is deformed and pressed on the shaft of the inserted golf club 4, keeping the inserted golf club 4 positively secured in place. Because shadow grooves 2221 are respectively disposed at two sides of each retaining portion 221, the retaining portions 221 of the flexible engagement plate 22 can easily be deformed to hold down the shaft of each inserted golf club.

Figure 7:
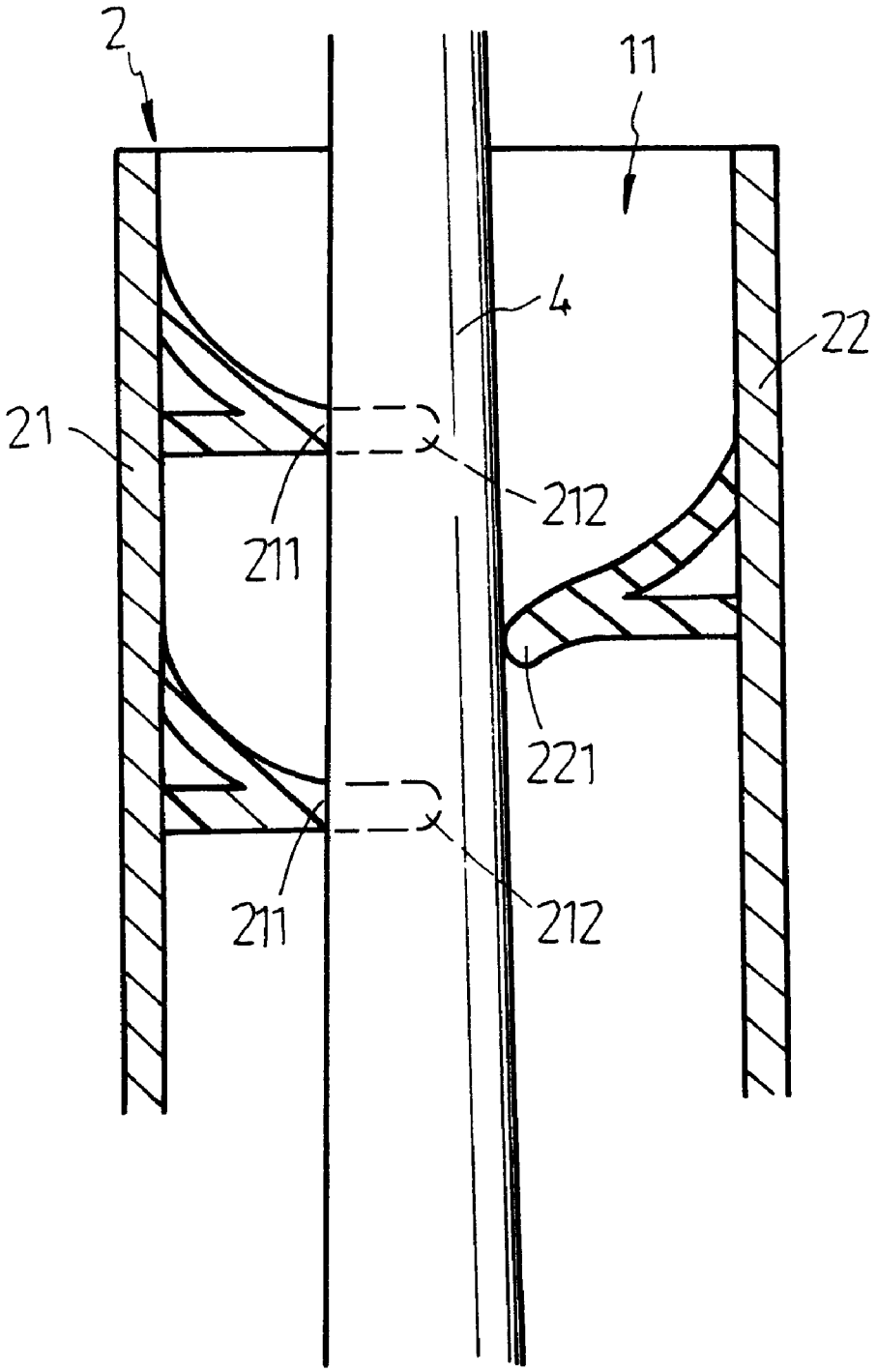
FIG. 7 is a sectional view showing an alternate form of the club shaft positioning device according to the present invention.
Figure 8:
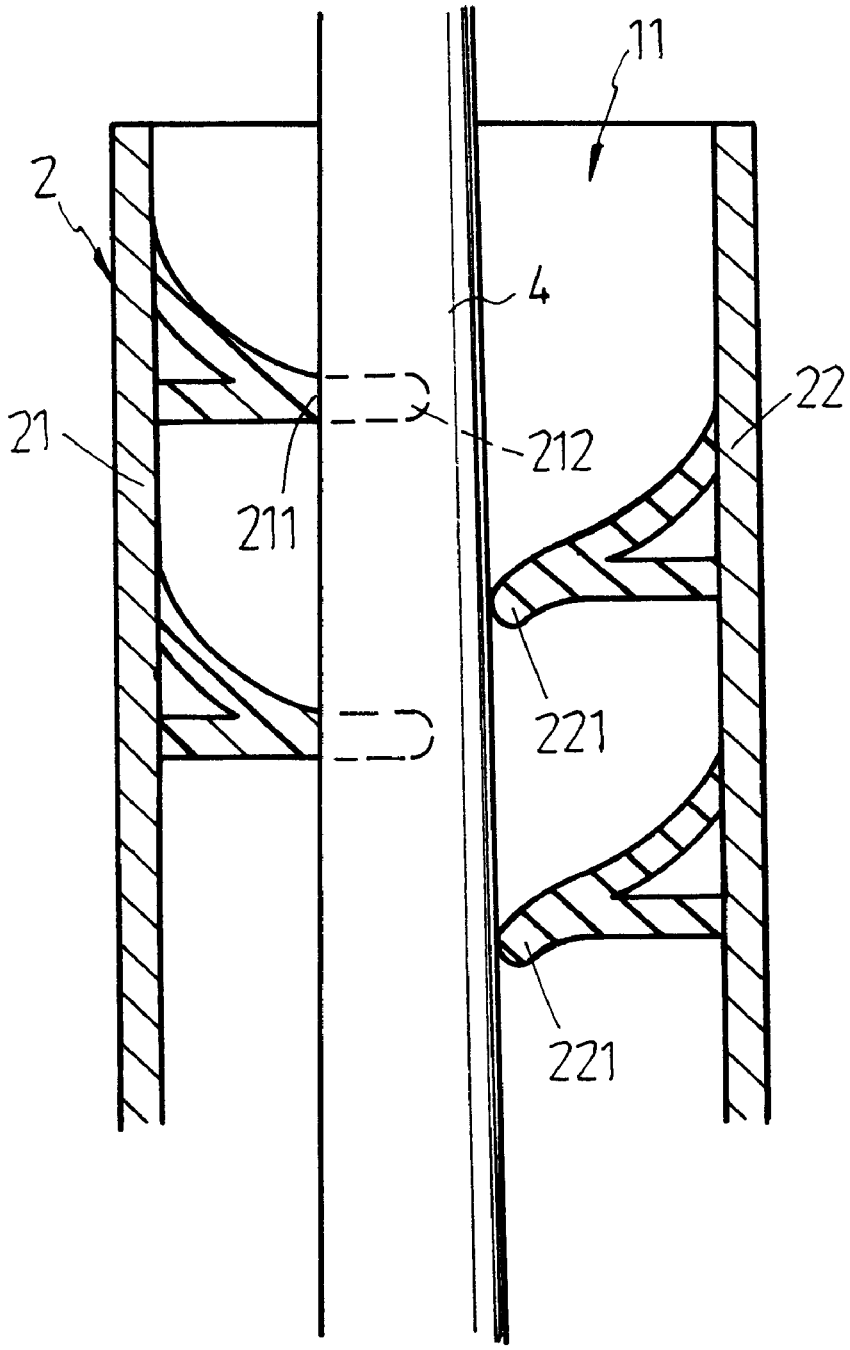
FIG. 8 is a sectional view showing another alternate form of the club shaft positioning device according to the present invention.
Figure 9:
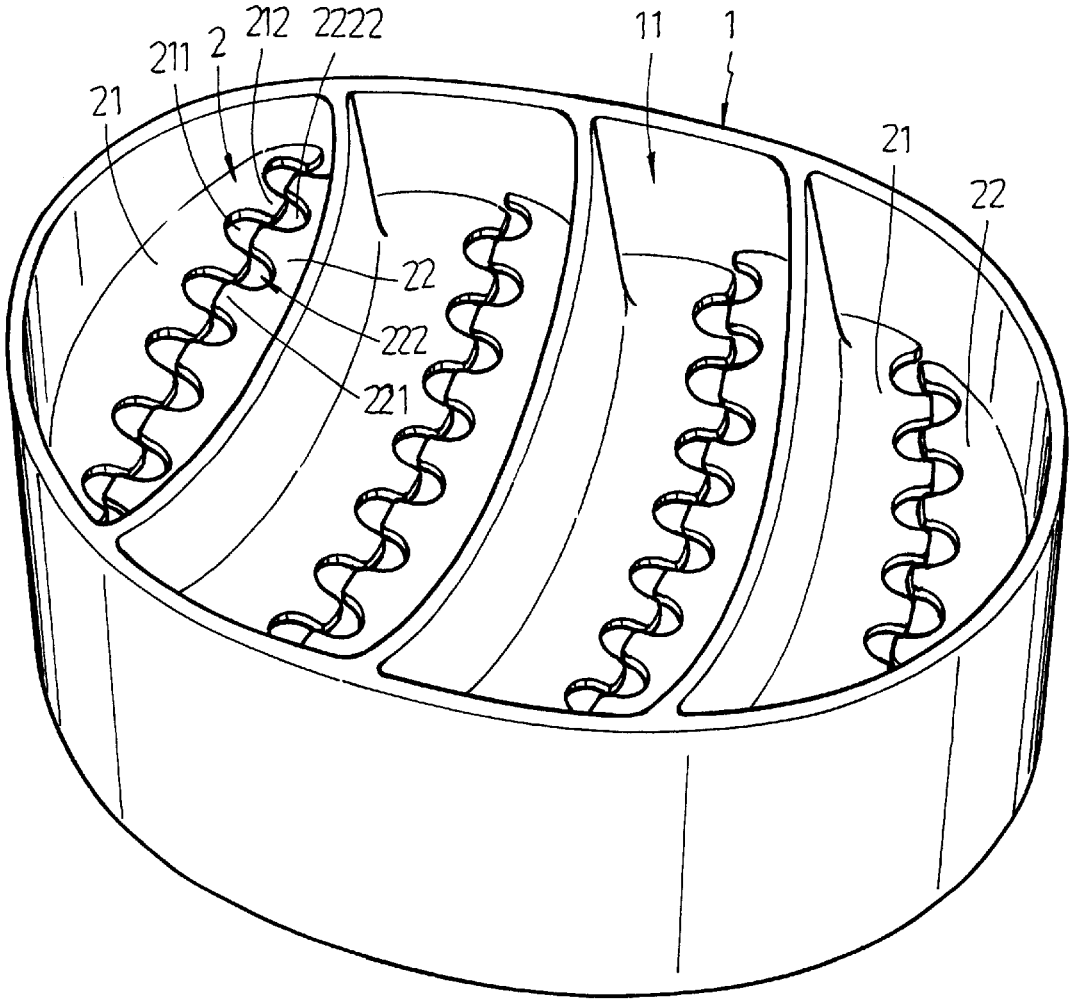
FIG. 9 is an elevational view of an alternate form of the top cuff for golf bag according to the present invention.
Figure 10:
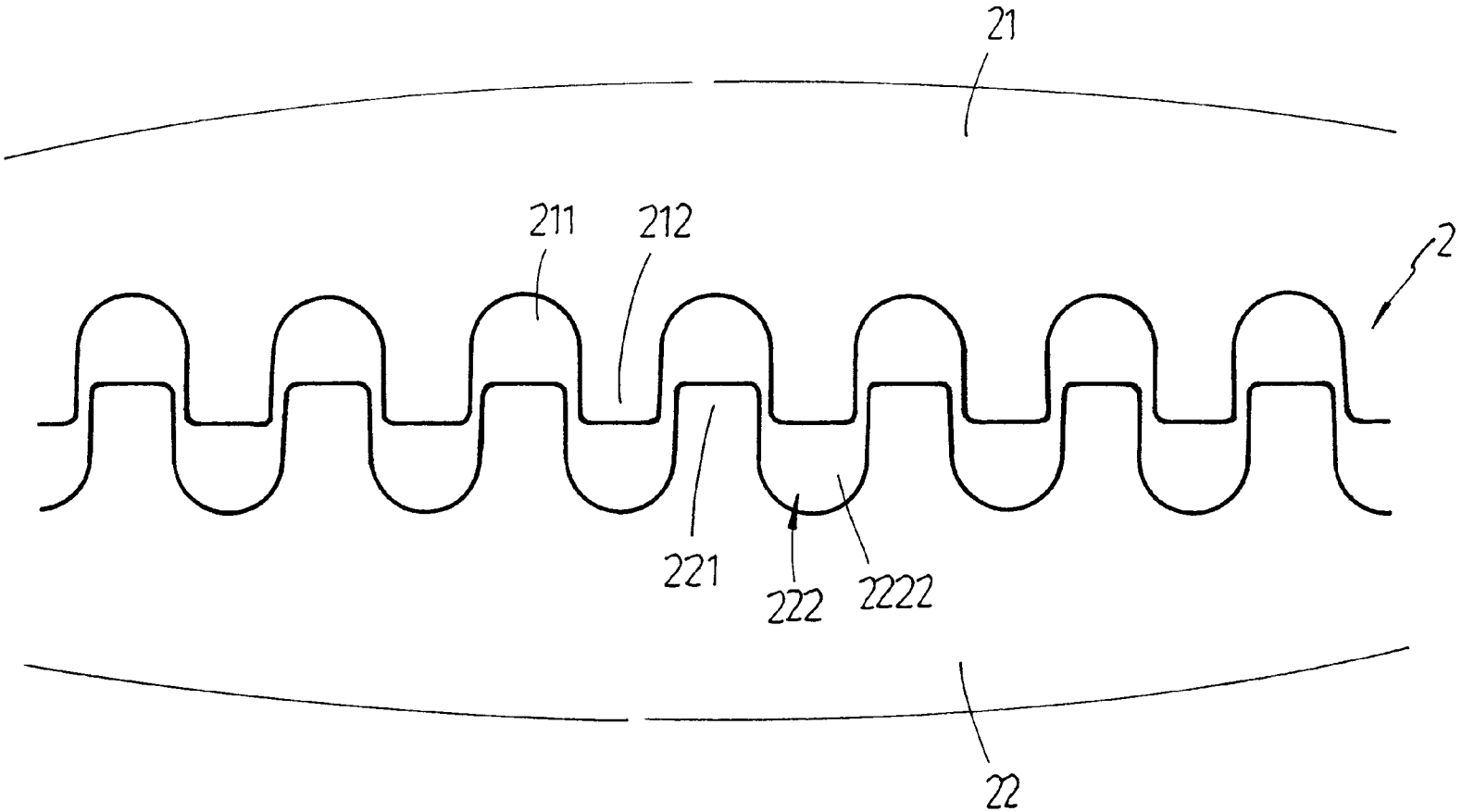
FIG. 10 is a top plain view in an enlarged scale of one insertion compartment of the top cuff shown in FIG. 9.
Figure 11:
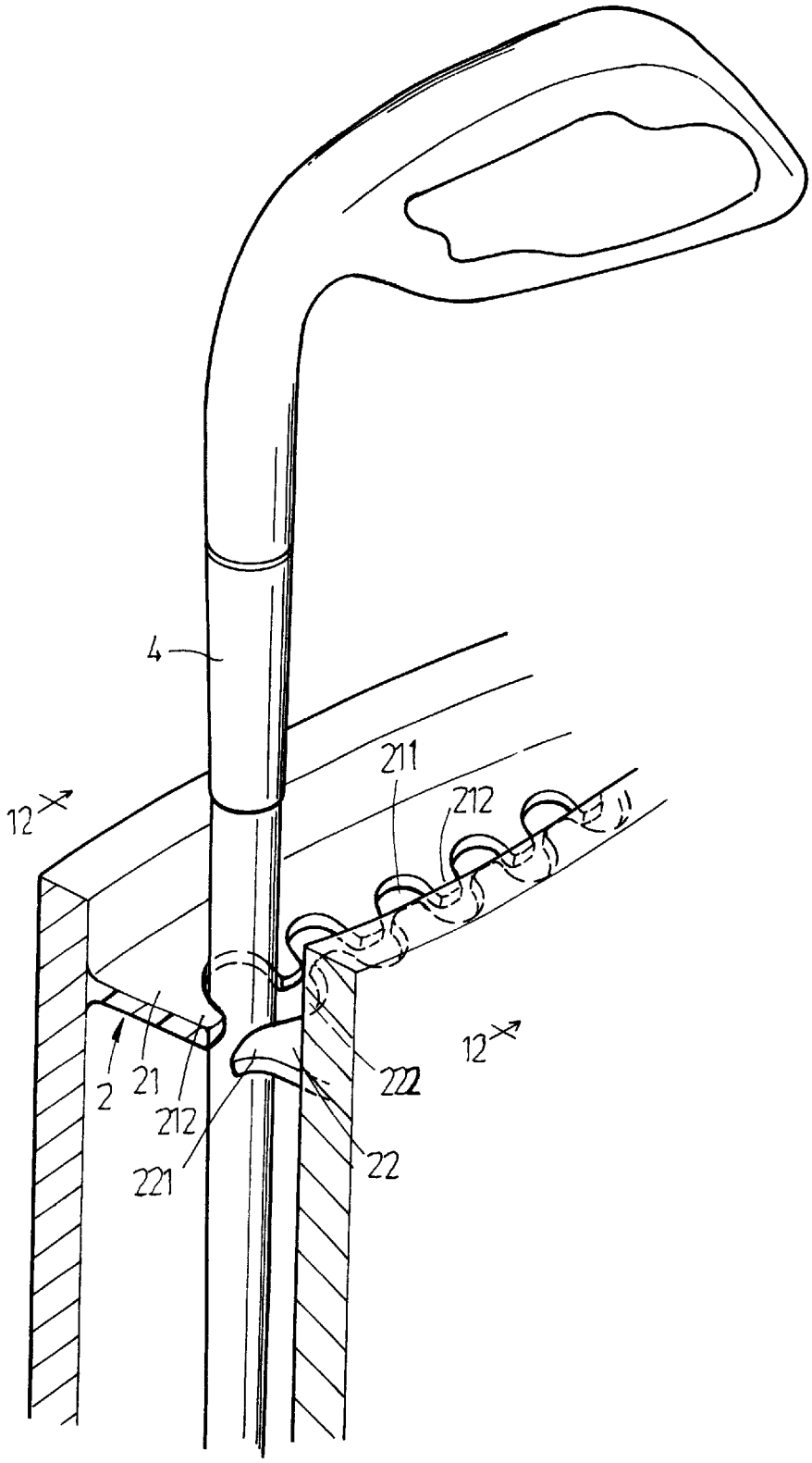
FIG. 11 is a perspective view showing the shaft of a golf club positioned in one peripheral notch of the hard locating plate shown in FIG. 10.
Figure 12:
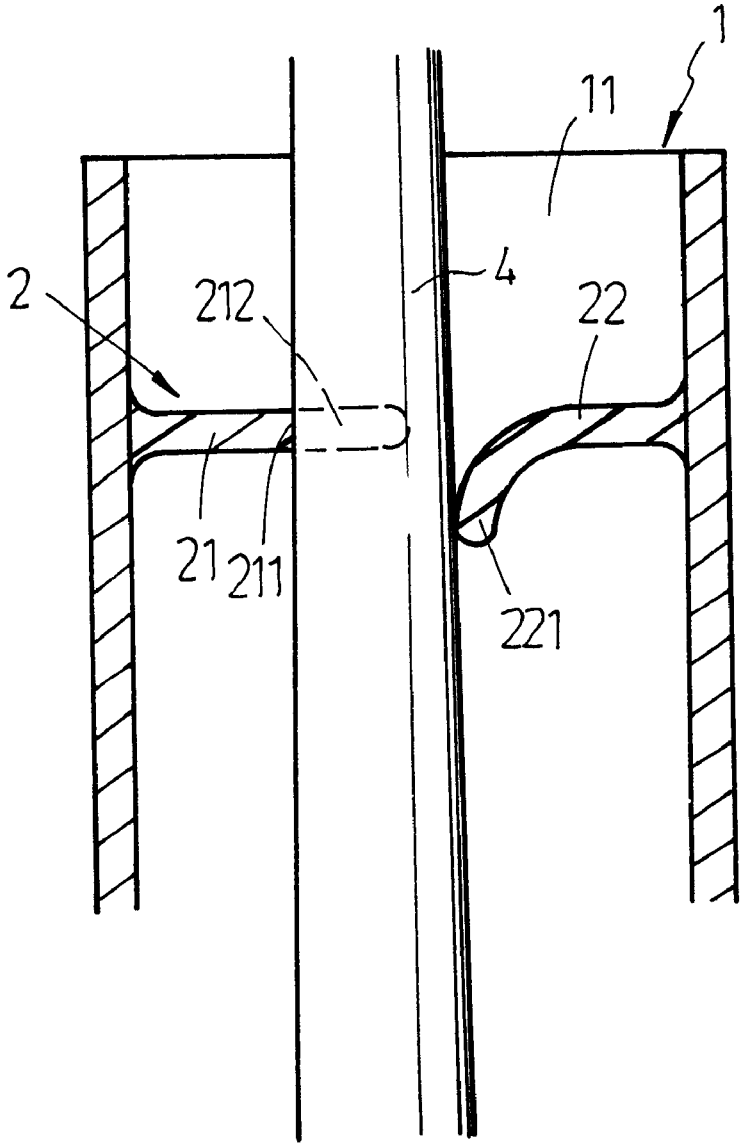
FIG. 12 is a sectional view taken along line 11—11 of FIG. 11.
Figure 13:
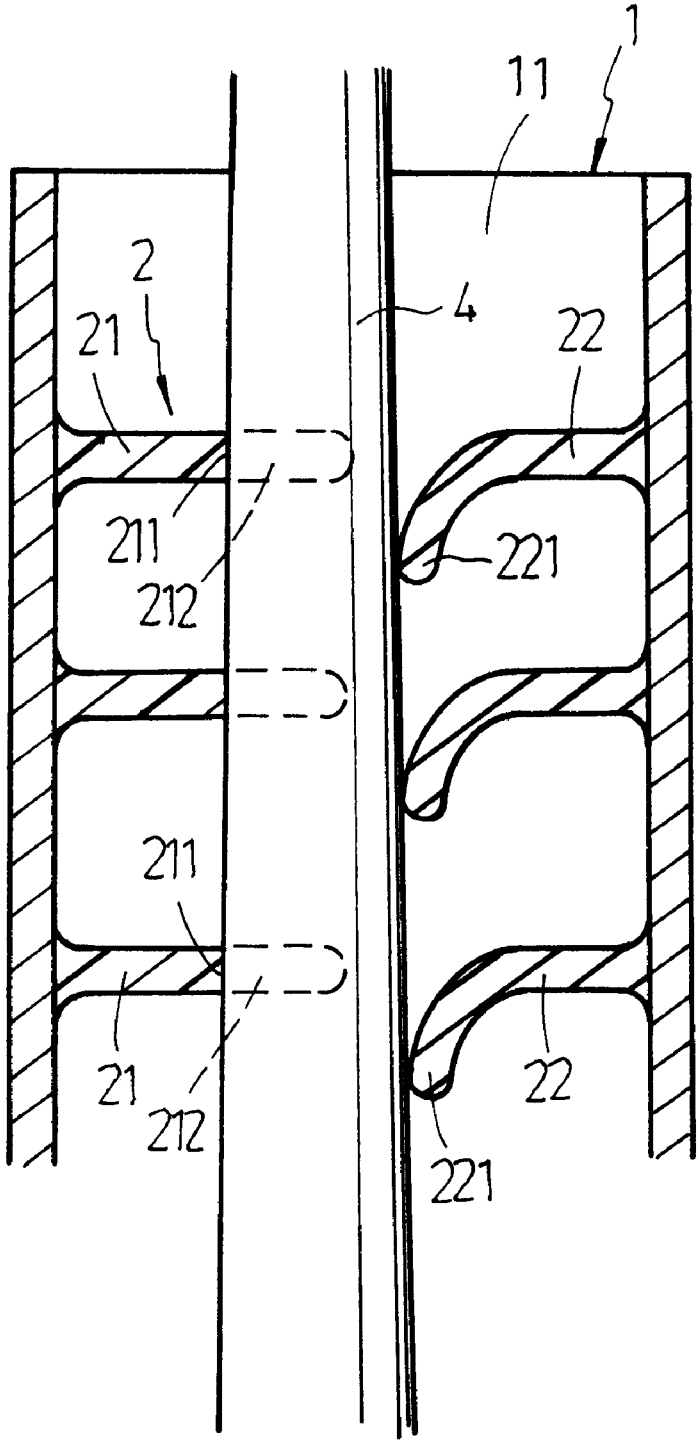
FIG. 13 illustrates an alternate form of the club shaft positioning device according to the embodiment shown in FIG. 9.

Referring to FIGS. 7 and 8, the club shaft positioning device 2 can be made having two hard locating plates 21 vertically spaced at one side of the insertion compartments 11 and a flexible engagement plate 22 disposed at an opposite side at an elevation between the hard locating plates 21; alternatively, the club shaft positioning device 2 can be made having two hard locating plates 21 and two flexible engagement plates 22 alternatively arranged at different elevations at two sides. In addition to the top cuff structure, a golf club positioning bottom block may be provided in the bottom cuff of the golf bag to hold the grip of each inserted golf club.

Referring to FIGS. from 9 through 13, the club shaft positioning device 2 can be made having at least one hard locating plate 21 and at least one flexible engagement plate 22 alternatively disposed at two sides at different elevations, wherein each hard locating plate 21 comprises a plurality of peripheral notches 211 and chamfered ribs 212 alternatively arranged in a line along the respective outer side; each flexible engagement plate 22 comprises a plurality of groove means 222 on the front side thereof corresponding to the chamfered ribs 212 of the adjacent hard locating plate 21. According to the present preferred embodiment, the groove means 222 are parallel slots 2222 cut through the front side of the flexible engagement plate 22, defining a plurality of separated retaining portions 221 corresponding to the peripheral notches 211 of the hard locating plate 21. Upon insertion of the shaft of one golf club 4 into one peripheral notch 211, the corresponding retaining portion 221 is curved downwards and pressed on the shaft of the inserted golf club 4, keeping the shaft of the inserted golf club in position.

It is to be understood that the drawings are designed for purposes of illustration only, and are not intended for use as a definition of the limits and scope of the invention disclosed.

What the invention claimed is:

1. A top cuff for a golf bag comprising:

a) a plurality of elongated insertion compartments each configured to receive a plurality of golf clubs therein;

b) at least one elongated hard locating plate in each insertion compartment, each hard locating plate extending into an associated insertion compartment from a first side thereof, each hard locating plate having a plurality of notches and ribs alternately arranged in a line; and, c) at least one flexible engagement plate in each insertion compartment, each flexible engagement plate extending into an associated insertion compartment from a second side thereof opposite the first side thereof, each flexible engagement plate having a plurality of grooves, each groove located opposite to one of the plurality of ribs of an associated hard locating plate, wherein, in each elongated insertion compartment, the hard locating plate is located at a height different from a height of the associated flexible engagement plate.

2. The top cuff for a golf bag as claimed in claim 1 wherein each flexible engagement plate has a thickness that diminishes in a direction away from the second side of the insertion compartment.

3. The top cuff for a golf bag as claimed in claim 1 wherein each hard locating plate has a thickness that diminishes in a direction away from the first side of the insertion compartment.

4. The top cuff for a golf bag as claimed in claim 1 comprising two spaced apart hard locating plates in each insertion compartment.

5. The top cuff for a golf bag as claimed in claim, 4 comprising a single flexible engagement plate in each insertion compartment.

6. The top cuff for a golf bag as claimed in claim 4 comprising two spaced apart flexible engagement plates in each insertion compartment.

* * * * *